US010719041B2

(12) United States Patent
Igarashi et al.

(10) Patent No.: US 10,719,041 B2
(45) Date of Patent: Jul. 21, 2020

(54) IMAGE FORMING APPARATUS

(71) Applicant: FUJI XEROX CO., LTD., Tokyo (JP)

(72) Inventors: Tatsuhiro Igarashi, Kanagawa (JP); Naoki Ota, Kanagawa (JP); Yusuke Fukuda, Kanagawa (JP); Makoto Kamisaki, Kanagawa (JP); Yasuhisa Morooka, Kanagawa (JP); Jun Sekiya, Kanagawa (JP); Teppei Yawada, Kanagawa (JP); Masataka Kuribayashi, Kanagawa (JP); Takafumi Koide, Kanagawa (JP); Katsuyuki Kitajima, Kanagawa (JP); Shota Oshima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/362,702

(22) Filed: Mar. 25, 2019

(65) Prior Publication Data

US 2020/0064760 A1 Feb. 27, 2020

(30) Foreign Application Priority Data

Aug. 27, 2018 (JP) ..... 2018-158611

(51) Int. Cl.
*G03G 15/20* (2006.01)
*G03G 15/16* (2006.01)

(52) U.S. Cl.
CPC ..... *G03G 15/2028* (2013.01); *G03G 15/161* (2013.01); *G03G 15/167* (2013.01); *G03G 15/2039* (2013.01); *G03G 15/2064* (2013.01)

(58) Field of Classification Search
CPC ..... G03G 15/2053; G03G 15/2025; G03G 2215/2032
See application file for complete search history.

(56) References Cited

U.S. PATENT DOCUMENTS

2008/0280219 A1* 11/2008 Nakayama ..... G03G 9/08711 430/48
2011/0110678 A1* 5/2011 Nishikawa ..... G03G 21/203 399/92

(Continued)

FOREIGN PATENT DOCUMENTS

| | | |
|---|---|---|
| JP | 2007-047450 | 2/2007 |
| JP | 2012-083420 | 4/2012 |
| JP | 2016-139161 | 8/2016 |

*Primary Examiner* — Walter L Lindsay, Jr.
*Assistant Examiner* — Jessica L Eley
(74) *Attorney, Agent, or Firm* — JCIPRNET

(57) ABSTRACT

An image forming apparatus includes an image holding member, a charging unit that charges the surface of the image holding member, an electrostatic charge image forming unit that forms an electrostatic charge image on the charged surface of the image holding member, a developing unit that includes a developer containing toner particles containing a release agent having a melting temperature ranging from 60° C. to 100° C. and that develops the electrostatic charge image on the surface of the image holding member with the developer to form a toner image, a transferring unit that transfers the toner image formed on the surface of the image holding member to the surface of a recording medium, and a fixing unit that fixes the toner image transferred to the surface of the recording medium, wherein the fixing unit includes an endless member to be heated, the endless member contacts with the toner image transferred to the surface of the recording medium; a pressure member that presses the endless member to form a nipping region between the pressure member and the endless member; a first heater that is in contact with the inner surface of the endless member in the nipping region to heat the endless member; a second heater that is disposed in contact with the endless member and downstream of the first heater in the operational direction of the endless member to heat the (Continued)

endless member; and a collection member that is disposed in the vicinity of the second heater so as to face the outer surface of the endless member and that collects particles.

15 Claims, 3 Drawing Sheets

(56) References Cited

U.S. PATENT DOCUMENTS

2015/0323892 A1* 11/2015 Sakamaki ..... G03G 15/20
399/327
2016/0202646 A1* 7/2016 Suzuki ..... G03G 15/2025
399/325

* cited by examiner

IMAGE FORMING APPARATUS

CROSS-REFERENCE TO RELATED APPLICATIONS

This application is based on and claims priority under 35 USC 119 from Japanese Patent Application No. 2018-158611 filed Aug. 27, 2018.

BACKGROUND (i) Technical Field

The present disclosure relates to an image forming apparatus.

(ii) Related Art

An electrophotographic process for forming an image, for example, includes charging the surface of an image holding member, forming an electrostatic charge image on this surface of the image holding member on the basis of image information, developing the electrostatic charge image with a developer containing toner to form a toner image, and transferring and fixing the toner image to the surface of a recording medium.

Japanese Laid Open Patent Application Publication No. 2007-047450 discloses a fixing device that thermally fixes an unfixed image formed of a toner containing wax by transporting a transfer material having the unfixed image to a fixing nip part formed between a pressure member and a fixing rotational body that has been heated and that comes into contact with the toner image on the transfer material for the thermal fixing and then nipping the transfer material; this fixing device includes a cleaning unit disposed upstream of the fixing rotational body in the rotational direction thereof to remove the dirt on the surface of the fixing rotational body and a wax uniformizing member that is disposed downstream of the cleaning unit and upstream of the fixing nip part in contact with the fixing rotational body, the cleaning unit has a cleaning rotational body being in contact with the fixing rotational body and a cleaning member being in contact with the cleaning rotational body, and the surface roughness Rz of the wax uniformizing member is smaller than the larger one of the surface roughness Rz of the cleaning rotational body and the surface roughness Rz of the cleaning member. Japanese Laid Open Patent Application Publication No. 2007-047450 also discloses an image forming apparatus having such a fixing device.

In the case where a toner image is formed of an electrostatic charge image developing toner (also simply referred to as "toner") having toner particles containing a release agent with a low melting temperature (for example, release agent having a melting temperature of 100° C. or less) and where the toner image is fixed with a fixing unit including an endless member to be heated, a first heater that is disposed in contact with the inner surface of the endless member to be heated, and a second heater that is disposed downstream of the first heater to additionally give heat to the endless member to be heated, particles derived from a vaporized release agent and having a size of 100 nm or less (namely, Ultra-Fine Particle, also simply referred to as "UFP") are likely to be generated in the vicinity of the second heater. The generated particles are discharged to the outside of an image forming apparatus in some cases.

SUMMARY

Aspects of non-limiting embodiments of the present disclosure relate to an image forming apparatus that includes a fixing unit which fixes a toner image transferred to the surface of a recording medium and that enables a reduction in the amount of particles derived from a release agent contained in a toner, having a size of 100 nm or less, and discharged to the outside of the image forming apparatus, as compared with the case in which the fixing unit only has an endless member to be heated, a pressure member that presses the outer surface of the endless member to form a nipping region between the pressure member and the endless member, a first heating member that is disposed in contact with the inner surface of the endless member in the nipping region to heat the endless member, and a second heating member that is disposed downstream of the first heating member in the operational direction of the endless member in contact with the endless member to heat the endless member to be heated.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an image holding member, a charging unit that charges the surface of the image holding member, an electrostatic charge image forming unit that forms an electrostatic charge image on the charged surface of the image holding member, a developing unit that includes a developer containing toner particles containing a release agent having a melting temperature ranging from 60° C. to 100° C. and that develops the electrostatic charge image on the surface of the image holding member with the developer to form a toner image, a transferring unit that transfers the toner image formed on the surface of the image holding member to the surface of a recording medium, and a fixing unit that fixes the toner image transferred to the surface of the recording medium, wherein the fixing unit includes an endless member to be heated, the endless member contacts with the toner image transferred to the surface of the recording medium; a pressure member that presses the endless member to form a nipping region between the pressure member and the endless member; a first heater that is in contact with the inner surface of the endless member in the nipping region to heat the endless member; a second heater that is disposed in contact with the endless member and downstream of the first heater in the operational direction of the endless member to heat the endless member; and a collection member that is disposed in the vicinity of the second heater so as to face the outer surface of the endless member and that collects particles.

BRIEF DESCRIPTION OF THE DRAWINGS

Exemplary embodiment of the present disclosure will be described in detail based on the following figure, wherein.

DETAILED DESCRIPTION

Figure 1:
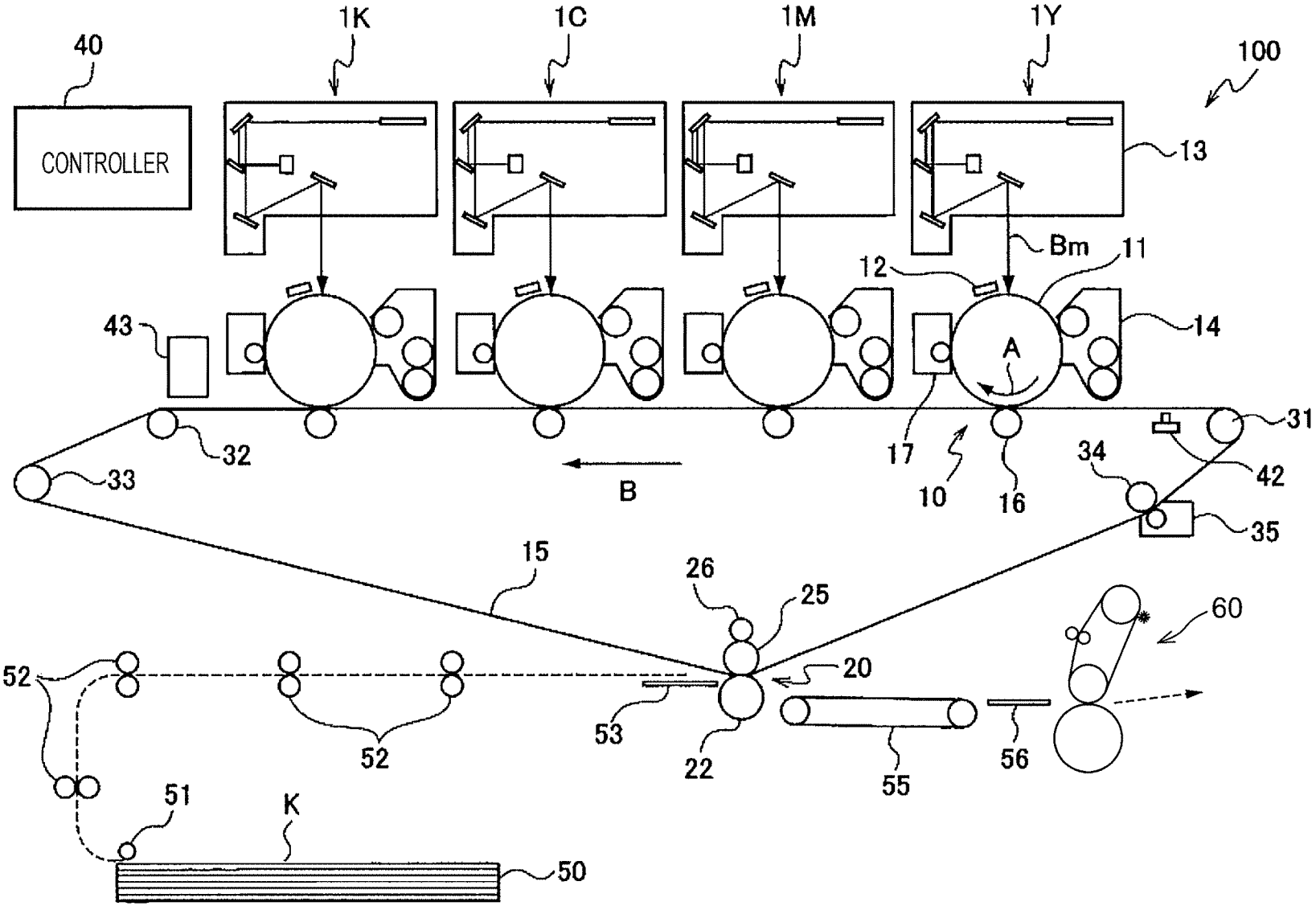
FIG. 1 schematically illustrates an example of the structure of an image forming apparatus according to an exemplary embodiment.

An exemplary embodiment that is an example of the present disclosure will now be described in detail.

Image Forming Apparatus

An image forming apparatus according to an exemplary embodiment includes an image holding member, a charging unit that charges the surface of the image holding member, an electrostatic charge image forming unit that forms an electrostatic charge image on the charged surface of the image holding member, a developing unit that has an electrostatic charge image developer and that develops the electrostatic charge image on the surface of the image holding member with the electrostatic charge image developer to form a toner image, a transfer unit that transfers the toner image formed on the surface of the image holding member to the surface of a recording medium, and a fixing unit that fixes the toner image transferred to the surface of the recording medium.

The electrostatic charge image developer accommodated in the developing unit contains an electrostatic charge image developing toner having toner particles containing a release agent with a melting temperature ranging from 60° C. to 100° C.

The fixing unit has an endless member to be heated that contacts with the toner image transferred to the surface of the recording medium, a pressure member that presses the outer surface of the endless member so that a nipping region is formed between the pressure member and the endless member, a first heater that is disposed in contact with the inner surface of the endless member in the nipping region to heat the endless member, a second heater that is disposed downstream of the first heater in the operational direction of the endless member in contact with the endless member to heat the endless member, and a collection member that is disposed in the vicinity of the second heater so as to face the outer surface of the endless member to collect particles.

The electrostatic charge image developing toner having toner particles containing a release agent with a melting temperature ranging from 60° C. to 100° C. is hereinafter also referred to as "specific toner".

Energy conservation has been demanded in recent years, and a technique for fixing toner at low temperature is therefore used to reduce power consumption in fixing of a toner image. In order to enhance fixability at low temperature, for example, toner including toner particles containing a release agent having a low melting temperature (such as a release agent having a melting temperature of 100° C. or less) is used in an electrostatic charge image developer accommodated in a developing unit of an image forming apparatus in some cases. In the case where a toner image is formed with such a toner containing a release agent having a low melting temperature and then fixed with a fixing unit including an endless member to be heated, a first heater disposed in contact with the inner surface of the endless member, and a second heater disposed downstream of the first heater to additionally give heat to the endless member, the release agent derived from the toner particles adhere to the endless member. Since temperature is high in the vicinity of the second heater, this high temperature is likely to vaporize the release agent adhering to the endless member in the vicinity of the second heater. The vaporized release agent solidifies in the air, which results in the generation of particles derived from the evaporated release agent and having a size of 100 nm or less (UFP: Ultra-Fine Particle). Such generated particles are discharged to the outside of the image forming apparatus in some cases.

In the image forming apparatus according to the exemplary embodiment, the fixing unit includes the collection member disposed in the vicinity of the outer surface of the endless member to be heated that is in contact with the second heater. Hence, the particles derived from the vaporized release agent and having a size of 100 nm or less are attracted by the collection member and thus collected. Accordingly, even when a toner of which the toner particles contain a release agent having a low melting temperature, such as the specific toner, is used to form an image, the particles derived from the release agent used in the toner and having a size of 100 nm or less are restrained from being discharged to the outside of the image forming apparatus.

The image forming apparatus of the exemplary embodiment may be any of the following known image forming apparatuses: a direct transfer type apparatus in which the toner image formed on the surface of the image holding member is directly transferred to a recording medium, an intermediate transfer type apparatus in which the toner image formed on the surface of the image holding member is transferred to the surface of an intermediate transfer member and in which the toner image transferred to the surface of the intermediate transfer member is then transferred to the surface of a recording medium, and an apparatus which has an erasing unit that radiates light to the surface of the image holding member for removal of charges after the transfer of the toner image and before charging.

In the intermediate transfer type apparatus, the transfer unit, for example, includes an intermediate transfer member of which a toner image is to be transferred to the surface, a first transfer member which transfers the toner image formed on the surface of the image holding member to the surface of the intermediate transfer member, and a second transfer member which transfers the toner image transferred to the surface of the intermediate transfer member to the surface of a recording medium.

In the structure of the image forming apparatus of the exemplary embodiment, for instance, the part that at least includes the image holding member may be in the form of a cartridge that is removably attached to the image forming apparatus (process cartridge).

The image forming apparatus according to the exemplary embodiment will now be described with reference to the drawings.

FIG. 1 schematically illustrates an example of the structure of the image forming apparatus according to the exemplary embodiment.

As illustrated in FIG. 1, an image forming apparatus 100 of the exemplary embodiment is, for example, an intermediate transfer type image forming apparatus that is a so-called tandem type. The image forming apparatus 100 includes image forming units 1Y, 1M, 1C, and 1K that individually form toner images of different color components by an electrophotographic technique; first transfer parts 10 that transfers the toner images of different color components formed by the image forming units 1Y, 1M, 1C, and 1K to an intermediate transfer belt 15 in sequence (first transfer); a second transfer part 20 that collectively transfers the toner images transferred onto the intermediate transfer belt 15 to paper K as a recording medium (second transfer); and a fixing device 60 (example of fixing unit) that fixes the images subjected to the second transfer onto the paper K. The image forming apparatus 100 further includes a controller 40 that gives information to each device (part) or receives information from it to control the operation thereof.

A unit having the intermediate transfer belt 15, the first transfer parts 10, and the second transfer part 20 corresponds to an example of the transfer unit.

Each of the image forming units 1Y, 1M, 1C, and 1K of the image forming apparatus 100 has a photoreceptor 11 as an example of the image holding member that carries a toner image formed on the surface thereof, and the photoreceptor 11 rotates in the direction indicated by the arrow A.

In the vicinity of the photoreceptor 11, a charger 12 that is an example of the charging unit is provided to charge the photoreceptor 11, and a laser exposure unit 13 that is an example of the electrostatic charge image forming unit is provided to write an electrostatic charge image on the photoreceptor 11 (exposure beam is indicated by the sign Bm in the drawing).

Also in the vicinity of the photoreceptor 11, a developing unit 14 that includes toner of a corresponding color component is provided as an example of the developing unit to turn the electrostatic charge image on the photoreceptor 11 into a visible image with toner, and a first transfer roller 16 that transfers the toner image of a corresponding color component on the photoreceptor 11 to the intermediate transfer belt 15 at the first transfer part 10.

The specific toner is used as toner of at least one of the color components. In the exemplary embodiment, it is suitable that the toner of each of the color components be the specific toner to produce fixability at low temperature.

Furthermore, a photoreceptor cleaner 17 is provided in the vicinity of the photoreceptor 11 to remove residual toner on the photoreceptor 11. The electrophotographic devices of the charger 12, laser exposure unit 13, developing unit 14, first transfer roller 16, and photoreceptor cleaner 17 are provided in sequence in the rotational direction of the photoreceptor 11. The image forming units 1Y, 1M, 1C, and 1K are disposed substantially in line in the order of yellow (Y), magenta (M), cyan (C), and black (K) from the upstream side of the intermediate transfer belt 15.

The intermediate transfer belt 15 is driven and circulates (rotates) by rollers at the intended rate in the direction denoted by the sign B in FIG. 1. Such rollers include a driving roller 31 that is driven by a motor (not illustrated) to rotate the intermediate transfer belt 15, a supporting roller 32 that supports the intermediate transfer belt 15 extending substantially in line along the direction in which the photoreceptors 11 are disposed, a tensile roller 33 that gives the intermediate transfer belt 15 tension and that functions as a correction roller that reduces meandering of the intermediate transfer belt 15, a back roller 25 provided to the second transfer part 20, and a cleaning back roller 34 provided to a cleaning part that scrapes off residual toner on the intermediate transfer belt 15.

The first transfer parts 10 each have a first transfer roller 16 as an opposite member that is disposed so as to face the photoreceptor 11 with the intermediate transfer belt 15 interposed therebetween. The first transfer roller 16 has a core and a sponge layer as an elastic layer adhering to the circumferential surface of the core. The core is a cylindrical bar made of metal such as iron or SUS. The sponge layer is formed of blended rubber of NBR, SBR, and EPDM, which contains a conductive agent such as a carbon black. The sponge layer is a cylindrical sponge roll having a volume resistivity ranging from $10^{7.5}$ Ωcm to $10^{8.5}$ Ωcm.

The first transfer roller 16 is disposed so as to be pressed against the photoreceptor 11 with the intermediate transfer belt 15 interposed therebetween, and a voltage (first transfer bias) is applied to the first transfer roller 16 in the polarity opposite to the polarity in which the toner has been charged (herein defined as negative polarity, the same holds true for the following description). Accordingly, toner images on the individual photoreceptors 11 are electrostatically drawn to the intermediate transfer belt 15 in sequence, and a composite toner image is formed on the intermediate transfer belt 15.

The second transfer part 20 has the back roller 25 and a second transfer roller 22 disposed so as to face the toner-image-carrying side of the intermediate transfer belt 15.

The surface of the back roller 25 is formed of a tube of blended rubber of EPDM and NBR in which carbon has been dispersed, and the inside thereof is formed of EPDM rubber. The back roller 25 is formed so as to have a surface resistivity ranging from $10^7$ Ω/□ to $10^{10}$ Ω/□, and the hardness thereof is adjusted to be, for instance, 70° (measured with ASKER Durometer Type C manufactured by Kobunshi Keiki Co., Ltd., the same holds true for the following description). The back roller 25 is disposed so as to face the back side of the intermediate transfer belt 15 and serves as a counter electrode of the second transfer roller 22, and a power-supplying roller 26 made of metal is provided in contact with the back roller 25 to steadily apply a second transfer bias.

The second transfer roller 22 has a core and a sponge layer as an elastic layer adhering to the circumferential surface of the core. The core is a cylindrical bar made of metal such as iron or SUS. The sponge layer is formed of blended rubber of NBR, SBR, and EPDM, which contains a conductive agent such as a carbon black. The sponge layer is a cylindrical sponge roller having a volume resistivity ranging from $10^{7.5}$ Ωcm to $10^{8.5}$ Ωcm.

The second transfer roller 22 is disposed so as to be pressed against the back roller 25 with the intermediate transfer belt 15 interposed therebetween. The second transfer roller 22 is grounded to form a second transfer bias between the back roller 25 and the second transfer roller 22, and thus a toner image is transferred by the second transfer to paper K (example of recording medium) that is to be transported to the second transfer part 20.

An intermediate transfer belt cleaner 35 that removes residual toner and paper dust on the intermediate transfer belt 15 after the second transfer to clean the surface thereof is provided to the intermediate transfer belt 15 downstream of the second transfer part 20 so as to be movable toward and away from the intermediate transfer belt 15.

The intermediate transfer belt 15, the first transfer parts 10 (first transfer rollers 16), and the second transfer part 20 (second transfer roller 22) correspond to an example of the transfer unit.

A reference signal sensor (home position sensor) 42 that generates a reference signal that is the basis for timing formation of images by the image forming units 1Y, 1M, 1C, and 1K is provided upstream of the image forming unit 1Y for yellow. In addition, an image density sensor 43 that adjusts image quality is provided downstream of the image forming unit 1K for black. The reference sensor 42 recognizes a mark provided on the back side of the intermediate transfer belt 15 and then generates a reference signal, and the controller 40 recognizes the reference signal and instructs the image forming units 1Y, 1M, 1C, and 1K to start formation of images.

The image forming apparatus of the exemplary embodiment has a transporting unit for transporting the paper K. The transporting unit includes a paper container 50 in which the paper K is accommodated, a paper feed roller 51 that takes out the paper K gathered in the paper container 50 at a predetermined timing to transport it, transport rollers 52 that transport the paper K taken out by the paper feed roller 51, a transport guide 53 that introduces the paper K transported by the transport rollers 52 to the second transfer part 20, a transport belt 55 that transports the paper K transported after the second transfer by the second transfer roller 22 to the fixing device 60 (example of fixing unit), and a fixing inlet guide 56 that guides the paper K to the fixing device 60.

The controller 40 is a computer that controls the whole apparatus and carries out a variety of operations. In particular, the controller 40 has, for instance, a central processing unit (CPU), a read only memory (ROM) that stores a variety of programs, a random access memory (RAM) used as a working area in execution of the programs, a nonvolatile memory that stores a variety of information, and input and output interfaces (I/O) (each not illustrated). The CPU, ROM, RAM, nonvolatile memory, and I/O are connected to each other via buses.

The image forming apparatus 100 has, in addition to the controller 40, an operation-displaying part, an image-processing part, an image memory, a storage part, and a communication part (each not illustrated). The operation-displaying part, the image-processing part, the image memory, the storage part, and the communication part are each connected to the I/O of the controller 40. The controller 40 exchanges information with the operation-displaying part, the image-processing part, the image memory, the storage part, and the communication part to control each part. The controller 40 controls a preset fixing temperature as well.

A basic process for forming an image in the image forming apparatus of the exemplary embodiment will now be described.

In the image forming apparatus of the exemplary embodiment, image data output from, for example, an image reader or personal computer (PC) (each not illustrated) is subjected to image processing with an image processor (not illustrated); and then the image forming units 1Y, 1M, 1C, and 1K perform an imaging operation.

The image processor performs image processing including shading compensation, misregistration correction, brightness/color space conversion, gamma correction, and a variety of image editing such as frame elimination, a color edit, and a moving edit on the basis of input data of reflectance. The image data subjected to the image processing is converted to colorant tone data of four colors of Y, M, C, and K and output to the laser exposure unit 13.

In the laser exposure unit 13, an exposure beam Bm emitted from, for example, a semiconductor laser is radiated to the photoreceptor 11 of each of the image forming units 1Y, 1M, 1C, and 1K on the basis of the input colorant tone data. The surfaces of the photoreceptors 11 of the image forming units 1Y, 1M, 1C, and 1K are charged with the charger 12; and the charged surfaces are subjected to scanning exposure with the laser exposure unit 13 to form electrostatic charge images. The formed electrostatic charge images are developed by the image forming units 1Y, 1M, 1C, and 1K into toner images of Y, M, C, and K, respectively.

The toner images formed on the photoreceptors 11 of the image forming units 1Y, 1M, 1C, and 1K are transferred to the intermediate transfer belt 15 at the first transfer parts 10 in which the individual photoreceptors 11 contacts with the intermediate transfer belt 15. More specifically, the first transfer is carried out in the first transfer parts 10 as follows: the first transfer rollers 16 apply voltage (first transfer bias) to the substrate of the intermediate transfer belt 15 in the polarity opposite to the polarity in which toner has been charged (negative polarity), and the toner images are placed one upon another on the surface of the intermediate transfer belt 15 in sequence.

After the toner images are sequentially subjected to the first transfer to the surface of the intermediate transfer belt 15, the intermediate transfer belt 15 moves to transport the toner images to the second transfer part 20. The transportation of the toner images to the second transfer part 20 causes the paper feed roller 51 in the transporting unit to rotate on the basis of the timing of the transportation of the toner images to the second transfer part 20, and paper K with the intended size is supplied from the paper container 50. The paper K supplied by the paper feed roller 51 is transported by the transport rollers 52 and then reaches the second transfer part 20 through the transport guide 53. Before the paper K reaches the second transfer part 20, the paper K is stopped, an alignment roller (not illustrated) rotates on the basis of the timing of the movement of the intermediate transfer belt 15 carrying the toner images to align the position of the paper K with the position of the toner images.

In the second transfer part 20, the second transfer roller 22 is pressed against the back roller 25 with the intermediate transfer belt 15 interposed therebetween. The paper K transported at the right timing enters between the intermediate transfer belt 15 and the second transfer roller 22. At this time, the power supplying roller 26 applies voltage (second transfer bias) in the polarity the same as the polarity in which toner has been charged (negative polarity), and then a transfer electric field is formed between the second transfer roller 22 and the back roller 25. The unfixed toner images carried by the intermediate transfer belt 15 is electrostatically transferred onto the paper K at one time at the second transfer part 20 at which the second transfer roller 22 and the back roller 25 are pressed against each other.

Then, the paper K having the toner images which are electrostatically transferred is transported by the second transfer roller 22 in a state in which it is separated from the intermediate transfer belt 15 and reaches the transport belt 55 provided downstream of the second transfer roller 22 in the direction in which the paper is transported. The transport belt 55 transports the paper K to the fixing device 60 at the optimum transport rate for the fixing device 60. The unfixed toner images on the paper K transported to the fixing device 60 are fixed onto the paper K with heat and pressure in the fixing device 60. The paper K having the fixed image is transported to an ejected paper holder (not illustrated) provided to an ejection part of the image forming apparatus.

After the transfer to the paper K is finished, residual toner on the intermediate transfer belt 15 is transported to the cleaning part by the rotation of the intermediate transfer belt 15 and then removed from the intermediate transfer belt 15 with the cleaning back roller 34 and the intermediate transfer belt cleaner 35.

Fixing Unit

The fixing device is an example of the fixing unit. In particular, the fixing device includes the endless member to be heated, the pressure member, the first heater, the second heater, and the collection member; the endless member contacts with a toner image transferred to the surface of a recording medium, the pressure member presses the outer surface of the endless member to form a nipping region between the pressure member and the endless member, the first heater is disposed in contact with the inner surface of the endless member in the nipping region to heat the endless member, the second heater is disposed in contact with the endless member and downstream of the first heater in the operational direction of the endless member to heat the endless member, and the collection member is disposed so as to face the outer surface of the endless member in the vicinity of the second heater to collect particles.

In the image forming apparatus according to the exemplary embodiment, the second heater is disposed in contact with the endless member and downstream of the first heater in the operational direction of the endless member and provided in addition to the first heater. The second heater may be disposed in contact with the inner surface of the endless member or in contact with the outer surface thereof. The collection member may collect not only UFPs but also UFPs and airborne particles other than UFPs.

Fixing Device of First Example

Figure 2:
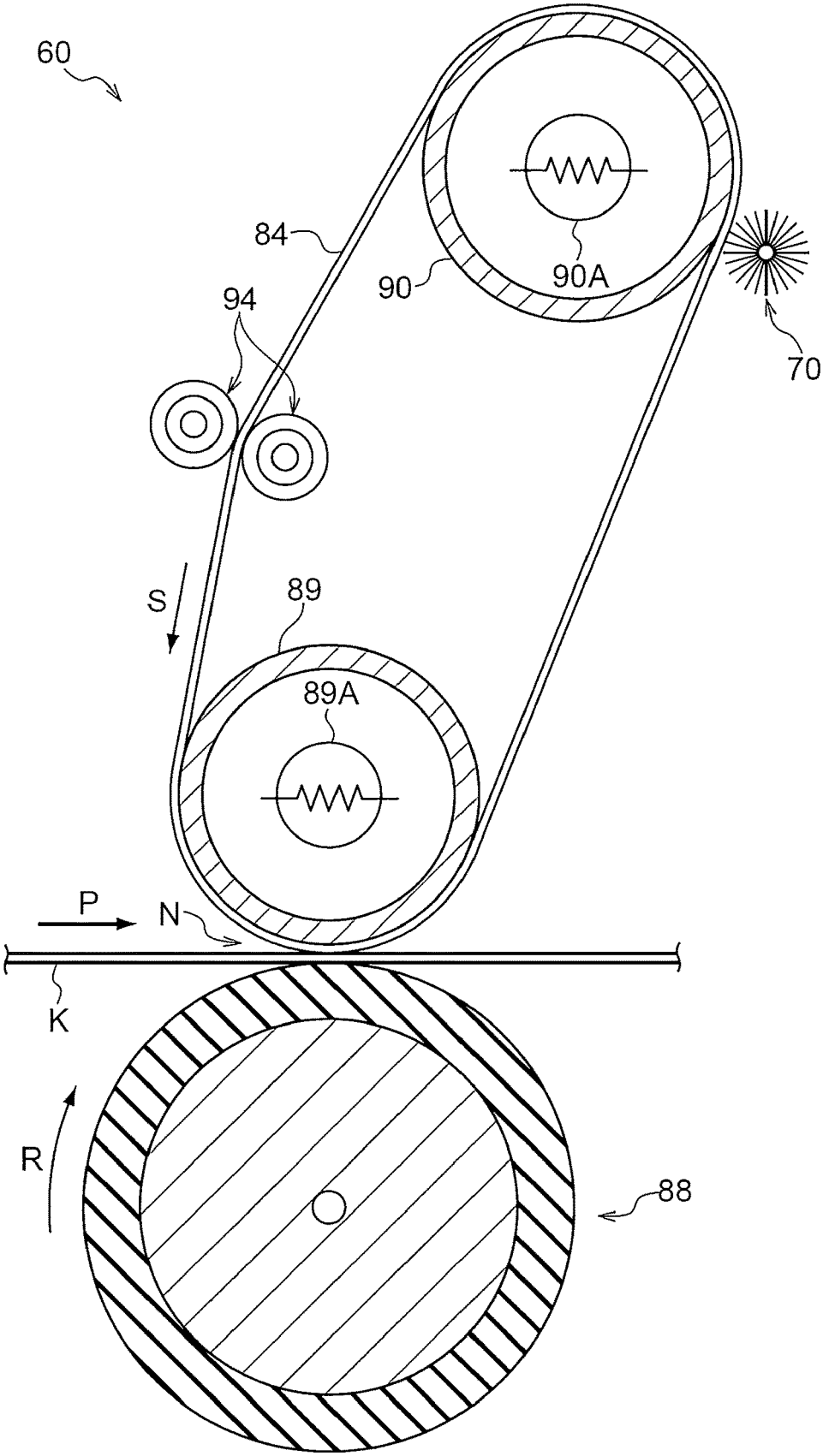
FIG. 2 schematically illustrates an example of the structure of a fixing unit used in the image forming apparatus according to the exemplary embodiment.

The fixing device 60 of a first example will now be described. In the first example, the fixing device 60 is explained as an example of a fixing device having a structure including the second heater disposed in contact with the inner surface of the endless member and the collection member disposed in contact with the outer surface of the endless member so as to face the second heater. FIG. 2 schematically illustrates an example of the structure of the fixing unit used in the image forming apparatus according to the exemplary embodiment; in particular, it illustrates an example of the fixing device as the first example of the fixing unit.

The fixing device 60 includes, for example, an endless fixing belt 84 (example of the endless member), a pressure roller 88 that presses the outer surface of the fixing belt 84 to form a nipping region N (nip part N) between the pressure roller 88 and the fixing belt 84 (example of the pressure member), a first heating roller 89 that is disposed in contact with the inner surface of the fixing belt 84 at the nip part N to heat the fixing belt 84 (example of the first heater), and a second heating roller 90 that is disposed in contact with the inner surface of the fixing belt 84 to heat the fixing belt 84 from the inside (example of the second heater).

The fixing device 60 includes a pair of support rollers 94 provided between the second heating roller 90 and the first heating roller 89 to support the fixing belt 84.

In the fixing device 60 used in the exemplary embodiment, the first heating roller 89 and the second heater different from the first heating roller 89 (namely, second heating roller 90) heat the fixing belt 84.

The collection member 70 that is in the form of a brush is disposed so as to face the outer surface of the fixing belt 84 in the vicinity of the second heating roller 90 disposed downstream of the first heating roller 89 in the operational direction of the fixing belt 84. The collection member 70 that is in the form of a brush is disposed so as to face the fixing belt 84 in contact therewith and rotates in the direction opposite to the rotational direction of the fixing belt 84. The collection member 70 that is in the form of a brush continuously extends along the direction vertical to the operational direction of the fixing belt 84. The detail of the collection member will be described later.

The first heating roller 89 is, for example, a cylindrical aluminum roller, and a halogen heater 89A as a heat source is disposed inside the first heating roller 89.

The fixing belt 84 is wound around the pressure-roller-88 side of the first heating roller 89. The first heating roller 89 is rotationally driven by the rotational force of a motor (not illustrated) and presses the inner surface of the fixing belt 84 toward the pressure roller 88 to heat the fixing belt 84 (nip part N) from the inside.

The second heating roller 90 is, for instance, a cylindrical aluminum roller, and a halogen heater 90A as a heat source is disposed inside the second heating roller 90 to heat the fixing belt 84 from the inside.

Each of the two ends of the second heating roller 90 in the axial direction, for instance, has a spring member (not illustrated) to press the fixing belt 84 outward.

The preset fixing temperatures of the first heating roller 89 and second heating roller 90 are suitably from 100° C. to 200° C., and preferably from 120° C. to 200° C. in terms of the fixability of toner at low temperature. The preset fixing temperature of the second heating roller 90 may be higher (from 15° C. to 20° C. higher) than that of the first heating roller 89 in the above-mentioned range of the preset fixing temperature in order to enhance the fixability.

The pair of the support rollers 94 are, for example, columnar rollers formed of aluminum.

The pressure roller 88 is, for example, rotatably supported and pressed by a pressing unit (not illustrated), such as a spring, against the part of the first heating roller 89 around which the fixing belt 84 is wound. Accordingly, the rotation of the fixing belt 84 in the direction denoted by the arrow S causes the pressure roller 88 to rotate in the direction denoted by the arrow R in conjunction with the rotation of the fixing belt 84 and first heating roller 89.

The paper K (example of recording medium) having an unfixed toner image (not illustrated) is transported in the direction denoted by the arrow P and guided to the nip part N of the fixing device 80, and then the toner image is fixed owing to the pressure and heat applied to the nip part N.

Fixing Device 80 of Second Example

Figure 3:
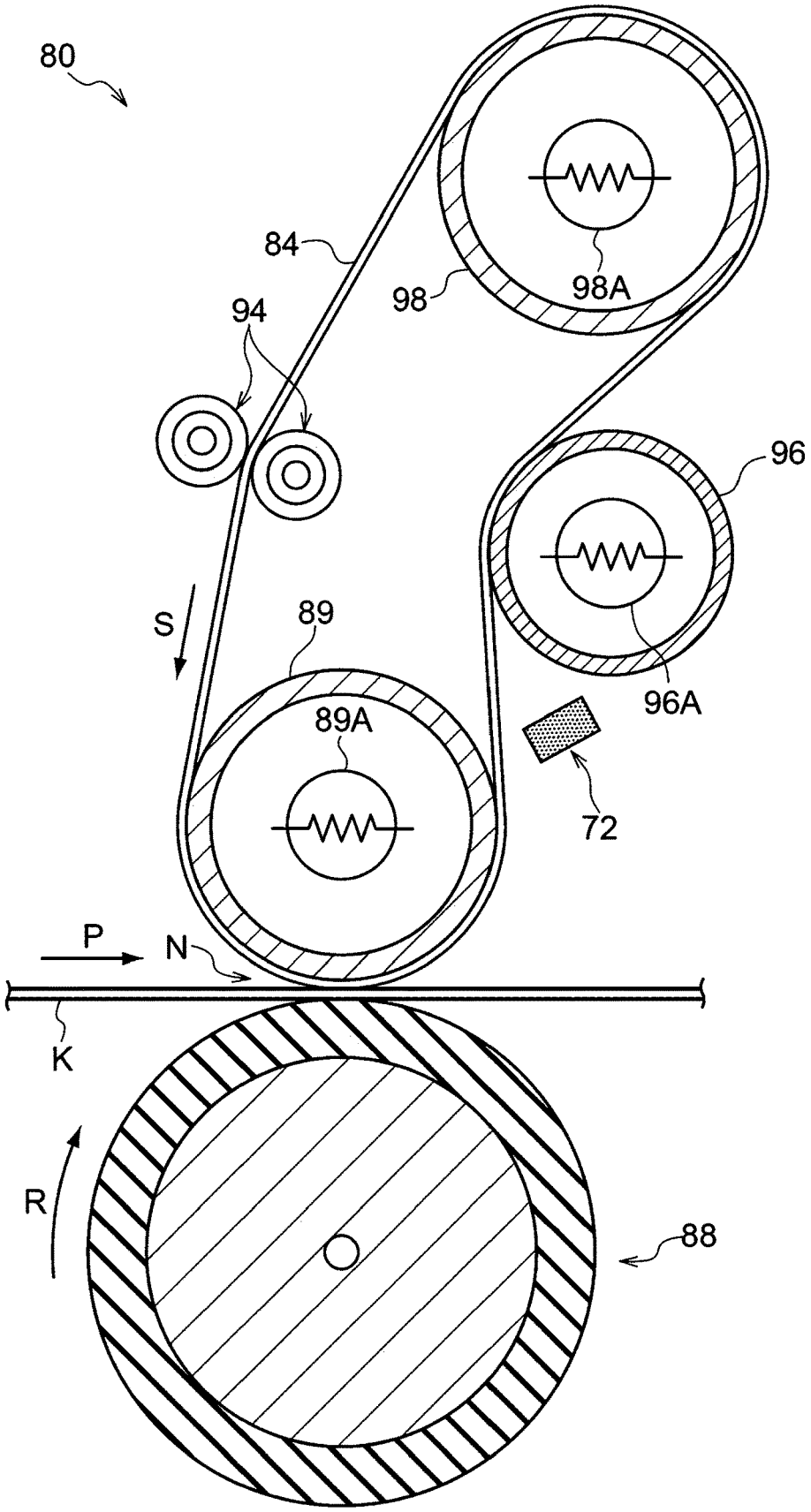
FIG. 3 schematically illustrates another example of the structure of the fixing unit used in the image forming apparatus according to the exemplary embodiment.

A fixing device 80 of a second example will now be described. In the second example, the fixing device 80 will be explained as an example of a fixing device having a structure including the second heater disposed in contact with the outer surface of the member to be heated to form a contact region and the collection member disposed in the vicinity of the contact region and upstream of the contact region in the operational direction of the endless member. FIG. 3 schematically illustrates another example of the structure of the fixing unit used in the image forming apparatus according to the exemplary embodiment; in particular, it illustrates the fixing device of the second example as an example of the fixing unit. The members having substantially the same functions as the members used in the fixing device 60 of the first example are denoted by the same reference signs, and the description thereof is omitted.

The fixing device 80 includes, for example, the endless fixing belt 84 (example of the endless member), the pressure roller 88 that presses the outer surface of the fixing belt 84 to form a nipping region N (nip part N) between the pressure roller 88 and the fixing belt 84 (example of the pressure member), the first heating roller 89 that is disposed in contact with the inner surface of the fixing belt 84 at the nip part N to heat the fixing belt 84 (example of the first heater), a second heating roller 96 that is disposed in contact with the outer surface of the fixing belt 84 so as to form a contact region and that heats the fixing belt 84 from the outside (example of the second heater), and a third heating roller 98 that is disposed in contact with the inner surface of the fixing belt 84 to heat the fixing belt 84 from the inside (example of a third heater).

The fixing device 80 includes a pair of support rollers 94 provided between the third heating roller 98 and the first heating roller 89 to support the fixing belt 84.

In the fixing device 80 used in the exemplary embodiment, the first heating roller 89 and the second heater (namely, second heating roller 96) and third heater (namely, third heating roller 98) different from the first heating roller 89 heat the fixing belt 84.

A collection member 72 is disposed so as to face the outer surface of the fixing belt 84. The collection member 72 is disposed in the vicinity of the second heating roller 96, which is downstream of the first heating roller 89 in the operational direction of the fixing belt 84, so as to be upstream of the contact region, in which the fixing belt 84 is in contact with the second heating roller 96, in the operational direction of the fixing belt 84. The collection member 72 is in the form of a plate and continuously extends along the direction vertical to the operational direction of the fixing belt 84. The shape of the cross-sectional surface of the collection member 72 in the longitudinal direction (the surface cut along the direction parallel to the operational direction of the fixing belt 84) is a quadrangle. The collection member 72 in FIG. 3 is provided in place of the collection member 70 in FIG. 2. The fixing device 80 may include the collection member 70 in FIG. 2 being in the shape of a brush instead of the collection member 72 in FIG. 3. The term "contact region" refers to the region from the contact of the outer surface of the running fixing belt 84 with the outer surface of the second heating roller 96 to the separation thereof from each other.

The second heating roller 96 is, for example, a cylindrical aluminum roller, and the surface of the second heating roller 96 has a release layer having a thickness of 20 μm and formed of a fluororesin.

The release layer of the second heating roller 96, for example, serves to prevent toner and paper dust on the outer surface of the fixing belt 84 from moving to the outer surface of the second heating roller 96 and accumulated thereon.

A halogen heater 96A as a heat source is, for instance, disposed inside the second heating roller 96 to heat the fixing belt 84 from the outside.

The third heating roller 98 has the same structure as the second heating roller 90 in FIG. 2. Specifically, for example, the third heating roller 98 is a cylindrical aluminum roller, and a halogen heater 98A as a heat source is disposed inside the third heating roller 98 to heat the fixing belt 84 from the inside.

Each of the two ends of the third heating roller 98 in the axial direction, for instance, has a spring member (not illustrated) to press the fixing belt 84 outward.

The preset fixing temperatures of the first heating roller 89, second heating roller 96, and third heating roller 98 are suitably from 100° C. to 200° C., and preferably from 120° C. to 200° C. in terms of the fixability of toner at low temperature. The preset fixing temperatures of the second heating roller 96 and third heating roller 98 may be higher (from 15° C. to 20° C. higher) than that of the first heating roller 89 in the above-mentioned range of the preset fixing temperature in order to enhance the fixability.

In the fixing device 60 of the first example, the fixing belt 84 is heated with the first heater (first heating roller 89) disposed in contact with the inner surface of the fixing belt at the nip part and the second heater (second heating roller 90) provided separately from the first heating roller 89; however, the heating of the fixing belt 84 is not limited thereto.

In the fixing device 80 of the second example, the fixing belt 84 is heated with the first heater (first heating roller 89) disposed in contact with the inner surface of the fixing belt at the nip part and the second heater (second heating roller 96) and third heater (third heating roller 98) provided separately from the first heating roller 89; however, the heating of the fixing belt 84 is not limited thereto.

The fixing belt may be, for example, heated in any of the following manners: heating the fixing belt with the first heater and one or more second heaters disposed so as to face the inner surface of the fixing belt, heating the fixing belt with the first heater and one or more second heaters disposed so as to face the outer surface of the fixing belt, and a combination of the foregoing.

A suitable example of heating of the fixing belt is to heat the fixing belt with the first heater, one third heater disposed so as to face the inner surface of the fixing belt, and one second heater disposed so as to face the outer surface of the fixing belt.

In this case, part of the fixing belt that is to be heated with at least one of one or more second heaters is suitably positioned downstream of the nip part in the rotational direction of the fixing belt and within 50$^{96}$ in the length from the nip part in the circumferential direction of the fixing belt.

A halogen heater (halogen lamp) is used as an example of the heat sources of the first heater and second heater in the fixing device 60 and as an example of the heat sources of the first heater, second heater, and third heater in the fixing device 80; however, the heat sources are not limited thereto. The heat sources may be heating elements of radiating lamps other than a halogen heater [such as a heating element that generates a radiation (e.g., infrared ray radiation)] or resistance heating elements (heating elements that generate Joule heat by allowing electric current to flow through a resistance, such as a product formed by forming a film having an electric resistance on a ceramic substrate and then burning the film).

The heat source of the second heater in the fixing device 60 and the heat sources of the second heater and third heater in the fixing device 80 may be heat sources involving electromagnetic induction heating (IH).

In the case where the second heater in the fixing device 60 has two or more heat sources or where the fixing device 80 includes two or more second heaters and third heaters, the multiple second heaters and the multiple third heaters may be individually the same as or different from each other.

In the fixing device 60 and the fixing device 80, a pressure roller is used as an example of the pressure member but not limited thereto. The pressure member may be a pressure belt.

Collection Member

The collection member may be in any form; for example, it may be in the form of a brush or another form different from a brush. The collection member may be a porous member having pores or a dense member having no pores. The collection member is suitably in the form of a brush or a porous member in terms of an enhancement in the efficiency of collecting UFPs. The collection member being in the form of a brush or a porous member has an enhanced specific surface area and is therefore likely to enhance the efficiency of collecting UFPs. Such a collection member enables a reduction in the amount of discharged particles that are derived from a release agent used in the toner and that have a size of 100 nm or less. The collection member may have a structure of a cartridge that is removably attached to the fixing device.

In the case where the collection member is in the form of a brush, the material of the collection member is not particularly limited. The collection member may be, for instance, formed of metal, ceramic, resin, or a composite material thereof. In the case where the collection member is formed of resin, the collection member may contain polyphenylene sulfide.

In the case where the collection member is in the form of a porous member or dense member other than the brush, the collection member may be in any shape; for example, it may be in the form of a film, a plate, or a rod. The shape of the cross-sectional surface of the collection member in the longitudinal direction thereof (surface cut along the direction parallel to the operational direction of the endless member) may be, for example, round, triangular, quadrangular, or polygonal. In the case where the collection member is in the form of a porous member or dense member other than the brush, the collection member suitably contains polyphenylene sulfide in terms of an enhancement in the efficiency of collecting UFPs. The amount of the polyphenylene sulfide is suitably 50 mass % or more, preferably 60 mass % or more, more preferably 70 mass % or more, and further preferably 80 mass % or more relative to the total mass of the collection member. The amount of the polyphenylene sulfide in the collection member may be 100 mass %. The more the amount of the polyphenylene sulfide is, the more UFPs derived from a release agent used in the toner adhere to the collection member; hence, the collection efficiency is likely to be enhanced. Thus, the amount of the UFPs discharged to the outside of the image forming apparatus is likely to be reduced.

The collection member may be rotatable or non-rotatable. The collection member may be disposed in non-contact with the endless member or in contact with the endless member. Furthermore, the collection member may be provided in contact with the endless member so as to be rotatable in the direction opposite to the operational direction of the endless member. The collection member may be, for example, in the form of a rotatable brush roller (example of the collection member in the form of a brush) and disposed in contact with the fixing belt (example of the endless member) so as to rotate in the direction opposite to the operational direction of the fixing belt. Such a collection member that is disposed in contact with the endless member so as to be rotatable in the direction opposite to the operational direction of the endless member may not only collect UFPs but also scrape a release agent derived from the toner adhering to the endless member. Thus, the amount of the UFPs discharged to the outside of the image forming apparatus is likely to be reduced.

The collection member may have a structure in which UFP-containing particles adhering to the collection member are collected by suctioning air from the inside of the collection member to reduce the amount of the UFPs discharged to the outside of the image forming apparatus. The collection member may be, for instance, in the form of a brush roller (example of the collection member being in the form of a brush) having a hollow shaft and a brush-like collection member attached to the circumference of the hollow shaft, and air is suctioned from the inside of the brush roller (hollow) to collect particles, such as UFPs, through air inlets formed in the surface of the brush roller into a particle collecting unit.

In the case where the collection member is a porous member, the area ratio of the pore area to the total area of the collection member (pore area/total area) is suitably 5 or more, the average pore size is suitably from 0.1 μm to 2.0 μm, and the thickness is suitably from 0.5 mm to 50 mm. The collection member having such a structure is likely to attract the UFPs derived from the release agent contained in the toner and readily contributes to an enhancement in collection efficiency. Particularly in the case where the area ratio of the pore area to the total area on the surface opposite to the second heater is in the above-mentioned range, efficiency of collecting the UFPs is enhanced; thus, such an area ratio is suitable. Accordingly, the amount of the UFPs discharged to the outside of the image forming apparatus is likely to be reduced.

The area ratio of the pore area to the total area in the collection member is preferably 7 or more, and more preferably 10 or more. The upper limit thereof is not particularly limited but may be, for example, 100 or less. The average pore size of the collection member is suitably from 0.3 μm to 1.0 μm. The thickness of the collection member is suitably from 20 mm to 50 mm.

The area ratio of the pore area to the total area, the pore size, and the thickness are measured as follows. A super-depth color 3D shape measuring microscope VK-9500 manufactured by Keyence Corporation is used, the area of a pore is defined as the pore area, the surface area determined in the depth direction of the pore is defined as the total area, the equivalent circle diameter of the pore is defined as the pore size, and the average thickness of the collection member is defined as the thickness.

The collection member may have a current plate that straightens the air flow in the vicinity of the second heater and that guides the particles to the collection member. Such a current plate may be, for instance, disposed in contact with at least part of the porous collection member. The structure of the current plate, such as a shape and an angle, and the position thereof in the collection member may be determined so that UFPs can be efficiently collected. The material of the current plate is not particularly limited; for example, the current plate may be formed of resin, metal, or ceramic.

The collection member may be positioned in the vicinity of the second heater so as to face the outer surface of the endless member and disposed at any position at which the UFPs can be collected. The collection member may be disposed in the vicinity of the second heater either upstream or downstream of the contact region, in which the endless member is in contact with the second heater, in the operational direction of the endless member. The collection member is suitably disposed upstream of the contact region, in which the endless member is in contact with the second heater, in the operational direction of the endless member in terms of an enhancement in the efficiency of collecting UFPs.

The vicinity of the second heater, in which the collection member is disposed, refers to the distance from the second heater to the collection member; in particular, it is the distance in the range in which particles including the UFPs can be collected. Specifically, the position at which the collection member is disposed is suitably in the following range. In order to efficiently collect UFPs, the suitable range is from 30 nm to 70 nm from the contact region in which the endless member is in contact with the second heater.

The collection member may continuously extend along the direction vertical to the operational direction of the endless member, or multiple collection members may be intermittently disposed along this direction. In the case where the collection members are intermittently disposed, the collection members may be connected to each other with a connection member. The collection members may be provided in a single line along the direction vertical to the operational direction of the endless member or in multiple lines.

Electrostatic Charge Image Developer

Toner used in the electrostatic charge image developer accommodated in the developing unit of the image forming apparatus according to the exemplary embodiment will now be described in detail.

The toner used in the exemplary embodiment will now be described in detail.

The toner used in the exemplary embodiment contains toner particles and optionally an external additive.

Toner Particles

The toner particles, for example, contain a binder resin, a release agent, and optionally a colorant and another additive.

Release Agent

The melting temperature of the release agent is from 60° C. to 100° C., preferably from 60° C. to 90° C., and more preferably from 60° C. to 75° C.

The melting temperature of the release agent at 100° C. or less enables an enhancement in the fixability of the toner at low temperature, so that the fixing temperature in the image forming apparatus can be lowered. At 100° C. or less of the melting temperature of the release agent, the release agent is likely to be vaporized in the fixing of the toner, and the vaporized release agent re-solidifies in air, which easily results in the generation of the UFPs. Even in this case, however, the amount of the UFPs discharged to the outside of the image forming apparatus is reduced according to the exemplary embodiment.

The melting temperature of the release agent at 60° C. or more reduces the adhesion of the release agent to the fixing member due to the unnecessary melting of the release agent in the fixing of the toner. In addition, such a melting temperature can reduce the excessive generation of the UFPs.

The melting temperature of the release agent can be controlled by any of known techniques, such as changing the type of release agent.

The melting temperature is determined from a DSC curve obtained by differential scanning calorimetry (DSC) in accordance with "Melting Peak temperature" described in determination of melting temperature in JIS K 7121-1987 "Testing Methods for Transition Temperatures of Plastics".

Examples of the release agent include, but are not limited to, mineral or petroleum waxes such as a montan wax, ozokerite, ceresin, a paraffin wax, a micro crystalline wax, and a Fischer-Tropsch wax; hydrocarbon waxes such as a polyethylene wax, a polypropylene wax, and a polybutene wax; a silicone wax; fatty acid amide waxes such as an oleamide wax, an erucamide wax, a ricinoleamide wax, and a stearamide wax; botanical waxes such as a carnauba wax, a rice bran wax, a candelilla wax, a Japan wax, and a jojoba oil; animal waxes such as beeswax; ester waxes such as a fatty acid ester, a montanic acid ester, and a carboxylic acid ester; and modified products thereof.

Among these, a paraffin wax, a low-molecular-weight polyethylene wax, a low-molecular-weight polypropylene wax, ceresin, a carnauba wax, and ester waxes, such as a fatty acid ester and a montanic acid ester, are preferred in terms of the fixability of the toner at low temperature; and a paraffin wax is more preferred.

The release agents may be used alone or in combination. In the case where two or more release agents are used, it is suitable that at least one of the release agents have a melting temperature being in the above-mentioned range, and it is more suitable that all of them have a melting temperature being in the above-mentioned range.

The amount of the release agent is, for example, preferably from 1 mass to 20 mass %, and more preferably from 5 mass to 15 mass % relative to the amount of the whole toner particles.

Melting Temperature of Release Agent and Preset Fixing Temperature

The difference between the melting temperature (T2) of the release agent and the preset fixing temperature (T1) of the fixing member of the image forming apparatus (namely, second heater) (T1−T2) is preferably from 30° C. to 140° C., more preferably from 40° C. to 120° C., and further preferably from 50° C. to 100° C.

When the preset fixing temperature (T1) is higher than the melting temperature (T2) of the release agent and the difference therebetween (T1−T2) is 140° C. or less, the fixing temperature in the image forming apparatus can be lowered. When the temperature difference (T1−T2) is 30° C. or higher, the adhesion of the toner to the fixing member can be reduced in the fixing of the toner. At the temperature difference (T1−T2) of 30° C. or higher, the release agent is likely to be vaporized in the fixing of the toner, and the vaporized release agent re-solidifies in air, which easily results in the generation of the UFPs. Even in this case, however, the amount of the UFPs discharged to the outside of the image forming apparatus is reduced according to the exemplary embodiment.

The term "preset fixing temperature" of the fixing member (namely, second heater) refers to a desired temperature of part of the surface, which contacts with an unfixed toner image, of the fixing member. In other words, it is a desired surface temperature of the fixing member at the moment of the contact with an unfixed toner image in such a state that the unfixed toner image has not received the heat.

Binder Resin

Examples of the binder resin include vinyl resins that are homopolymers of monomers such as styrenes (such as styrene, p-chlorostyrene, and a-methylstyrene), (meth)acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene) or copolymers of two or more of these monomers.

Other examples of the binder resin include non-vinyl resins such as epoxy resins, polyester resins, polyurethane resins, polyamide resins, cellulose resins, polyether resins, and modified rosin; mixtures thereof with the above-mentioned vinyl resins; and graft polymers obtained by polymerization of a vinyl monomer in the coexistence of such non-vinyl resins.

These binder resins may be used alone or in combination. The binder resin suitably contains a crystalline resin in order to enhance the fixability of the toner at low temperature.

The binder resin is suitably a polyester resin. In particular, the binder resin is suitably crystalline polyester.

Examples of the polyester resin include known amorphous polyester resins. The polyester resin may be a combination of the amorphous polyester resin and a crystalline polyester resin.

The "crystallinity" of a resin refers to that the resin does not have a stepwise change in the amount of heat absorption but have a definite endothermic peak in the differential scanning calorimetry (DSC). Specifically, it refers to that the half-value width of the endothermic peak in the measurement at a rate of temperature increase of 10 (° C./min) is within 10° C. The "amorphous properties" of a resin refers to that the half-value width of the endothermic peak exceeds 10° C., that a stepwise change in the amount of heat absorption is exhibited, or that definite endothermic peak is not observed.

Amorphous Polyester Resin

Examples of the amorphous polyester resin include polycondensates of a polycarboxylic acid with a polyhydric alcohol. The amorphous polyester resin may be a commercially available product or may be a synthesized resin.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenylsuccinic acid, adipic acid, and sebacic acid); alicyclic dicarboxylic acids (such as cyclohexanedicarboxylic acid); aromatic dicarboxylic acids (such as terephthalic acid, isophthalic acid, phthalic acid, and naphthalenedicarboxylic acid); anhydrides of the foregoing; and lower alkyl esters (having, for example, from 1 to 5 carbon atoms) of the foregoing. Of these, for example, aromatic dicarboxylic acids are suitable as the polycarboxylic acid.

The polycarboxylic acid may be a combination of the dicarboxylic acid with a carboxylic acid that has three or more carboxy groups and that gives a cross-linked structure or a branched structure. Examples of the carboxylic acid having three or more carboxy groups include trimellitic acid and pyromellitic acid, anhydrides of the foregoing, and lower alkyl esters (having, for example, from 1 to 5 carbon atoms) of the foregoing.

Such polycarboxylic acids may be used alone or in combination.

Examples of the polyhydric alcohol include aliphatic diols (such as ethylene glycol, diethylene glycol, triethylene glycol, propylene glycol, butanediol, hexanediol, and neopentyl glycol); alicyclic diols (such as cyclohexanediol, cyclohexanedimethanol, and hydrogenated bisphenol A); and aromatic diols (such as ethylene oxide adducts of bisphenol A and propylene oxide adducts of bisphenol A). Among these, for example, aromatic diols and alicyclic diols are preferred as the polyhydric alcohol, and aromatic diols are more preferred.

The polyhydric alcohol may be a combination of the diol with a polyhydric alcohol that has three or more hydroxy groups and that gives a cross-linked structure or a branched structure. Examples of the polyhydric alcohol having three or more hydroxy groups include glycerin, trimethylolpropane, and pentaerythritol.

Such polyhydric alcohols may be used alone or in combination.

The amorphous polyester resin has a glass transition temperature (Tg) ranging preferably from 50° C. to 80° C., and more preferably from 50° C. to 65° C.

The glass transition temperature is determined from a DSC curve obtained by differential scanning calorimetry (DSC) and can be specifically determined in accordance with "Extrapolated Starting Temperature of Glass Transition" described in determination of glass transition temperature in JIS K 7121-1987"Testing Methods for Transition Temperatures of Plastics".

The amorphous polyester resin has a weight average molecular weight (Mw) ranging preferably from 5000 to 1000000, and more preferably from 7000 to 500000.

The amorphous polyester resin suitably has a number average molecular weight (Mn) ranging from 2000 to 100000.

The amorphous polyester resin has a molecular weight distribution Mw/Mn ranging preferably from 1.5 to 100, and more preferably from 2 to 60.

The weight average molecular weight and number average molecular weight are measured by gel permeation chromatography (GPC). The measurement of the molecular weight by GPC involves using a measurement apparatus that is GPC·HLC-8120GPC manufactured by Tosoh Corporation, a column that is TSK gel Super HM-M (15 cm) manufactured by Tosoh Corporation, and a tetrahydrofuran (THF) solvent. From results of such measurement, the weight average molecular weight and the number average molecular weight are calculated from a molecular weight calibration curve plotted on the basis of a standard sample of monodisperse polystyrene.

The amorphous polyester resin can be produced by any of known techniques. In particular, the amorphous polyester resin is, for example, produced through a reaction at a polymerization temperature ranging from 180° C. to 230° C. optionally under reduced pressure in the reaction system, while water or alcohol that is generated in condensation is removed.

In the case where monomers as the raw materials are not dissolved or compatible at the reaction temperature, a solvent having a high boiling point may be used as a solubilizing agent in order to dissolve the raw materials. In such a case, the polycondensation reaction is performed while the solubilizing agent is distilled away. In the case where monomers having low compatibility are used in the copolymerization reaction, such monomers are preliminarily subjected to condensation with an acid or alcohol that is to undergo polycondensation with the monomers, and then the resulting product is subjected to polycondensation with the principle components.

Crystalline Polyester Resin

Examples of the crystalline polyester resin include polycondensates of a polycarboxylic acid with a polyhydric alcohol. The crystalline polyester resin may be a commercially available product or a synthesized resin.

The crystalline polyester resin may be suitably a polycondensate prepared from polymerizable monomers having linear aliphatics rather than a polycondensate prepared from polymerizable monomers having aromatics in terms of easy formation of a crystal structure.

Examples of the polycarboxylic acid include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid); aromatic dicarboxylic acids (e.g., dibasic acids such as phthalic acid, isophthalic acid, terephthalic acid, and naphthalene-2,6-dicarboxylic acid); anhydrides of these dicarboxylic acids; and lower alkyl esters (having, for example, from 1 to 5 carbon atoms) of these dicarboxylic acids.

The polycarboxylic acid may be a combination of the dicarboxylic acid with a carboxylic acid that has three or more carboxy groups and that gives a cross-linked structure or a branched structure. Examples of the carboxylic acid having three carboxy groups include aromatic carboxylic acids (such as 1,2,3-benzenetricarboxylic acid, 1,2,4-benzenetricarboxylic acid, and 1,2,4-naphthalenetricarboxylic acid); anhydrides of these tricarboxylic acids; and lower alkyl esters (having, for example, from 1 to 5 carbon atoms) of these tricarboxylic acids.

The polycarboxylic acid may be a combination of these dicarboxylic acids with a dicarboxylic acid having a sulfonic group or a dicarboxylic acid having an ethylenic double bond.

The polycarboxylic acids may be used alone or in combination.

Examples of the polyhydric alcohol include aliphatic diols (such as linear aliphatic diols having a backbone with from 7 to 20 carbon atoms). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol are suitable.

The polyhydric alcohol may be a combination of the diol with an alcohol that has three or more hydroxy groups and that gives a cross-linked structure or a branched structure. Examples of the alcohol having three or more hydroxy groups include glycerin, trimethylolethane, trimethylolpropane, and pentaerythritol.

The polyhydric alcohols may be used alone or in combination.

The aliphatic diol content in the polyhydric alcohol may be 80 mold or more, and suitably 90 molt or more.

The melting temperature of the crystalline polyester resin is preferably from 50° C. to 100° C., more preferably from 55° C. to 90° C., and further preferably from 60° C. to 85° C.

The melting temperature is determined from a DSC curve obtained by differential scanning calorimetry (DSC) in accordance with "Melting Peak temperature" described in determination of melting temperature in JIS K 7121-1987 "Testing Methods for Transition Temperatures of Plastics".

The weight average molecular weight (Mw) of the crystalline polyester resin is suitably from 6,000 to 35,000.

The crystalline polyester resin can be, for example, produced by any of known techniques as in production of the amorphous polyester resin.

The amount of the binder resin is, for instance, preferably from 40 mass % to 95 mass %, more preferably from 50 mass % to 90 mass %, and further preferably from 60 mass % to 85 relative to the whole toner particles.

The amount of the crystalline resin is preferably from 3 mass % to 20 mass %, and more preferably from 5 mass % to 15 mass % relative to the whole toner particles in order to enhance the fixability of the toner at low temperature.

Colorant

Examples of the colorant include a variety of pigments, such as carbon black, chrome yellow, Hansa Yellow, benzidine yellow, indanthrene yellow, quinoline yellow, pigment yellow, permanent orange GTR, pyrazolone Orange, Vulcan Orange, Watchung Red, Permanent Red, Brilliant Carmine 3B, Brilliant Carmine 6B, Du Pont Oil Red, pyrazolone red, lithol red, rhodamine B lake, lake red C, pigment red, rose bengal, aniline blue, ultramarine blue, chalco oil blue, methylene blue chloride, phthalocyanine blue, pigment blue, phthalocyanine green, and malachite green oxalate, and a variety of dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination. The colorant may be optionally a surface-treated colorant or may be used in combination with a dispersant. Different types of colorant may be used in combination.

The amount of the colorant is, for instance, preferably from 1 mass to 30 mass %, and more preferably from 3 mass % to 15 mass % relative to the amount of the whole toner particles.

Other Additives

Examples of other additives include known additives such as a magnetic material, a charge-controlling agent, and inorganic powder. These additives are contained in the toner particles as internal additives.

Characteristics of Toner Particles

The toner particles may have a monolayer structure or may have a core shell structure including a core (core particle) and a coating layer (shell layer) that covers the core.

The toner particles having a core shell structure, for instance, properly include a core containing the binder resin and optionally an additive, such as a colorant or a release agent, and a coating layer containing the binder resin.

The volume average particle size (D50*v*) of the toner particles is preferably from 2 μm to 10 μm, and more preferably from 4 μm to 8 μm.

The average particle size of the toner particles and the index of the particle size distribution thereof are measured with COULTER MULTISIZER II (manufactured by Beckman Coulter, Inc.) and an electrolyte that is ISOTON-II (manufactured by Beckman Coulter, Inc.).

In the measurement, from 0.5 mg to 50 mg of a test sample is added to 2 ml of an aqueous solution of a 5% surfactant (suitably sodium alkylbenzene sulfonate) as a dispersant. This product is added to from 100 ml to 150 ml of the electrolyte.

The electrolyte suspended with the sample is subjected to dispersion for 1 minute with an ultrasonic disperser and then subjected to the measurement of the particle size distribution of particles having a particle size ranging from 2 μm to 60 μm using COULTER MULTISIZER II with an aperture having an aperture diameter of 100 μm. The number of sampled particles is 50,000.

Cumulative distributions by volume and by number are drawn from the smaller diameter side in particle size ranges (channels) into which the measured particle size distribution is divided. The particle size for a cumulative percentage of 16% is defined as a volume particle size D16*v* and a number particle size D16*p*, while the particle size for a cumulative percentage of 50% is defined as a volume average particle size D50*v* and a number average particle size D50*p*. Furthermore, the particle size for a cumulative percentage of 84% is defined as a volume particle size D84*v* and a number particle size D84*p*.

From these particle sizes, the index of the volume particle size distribution (GSDv) is calculated as $(D84v/D16v)^{1/2}$, while the index of the number particle size distribution (GSDp) is calculated as $(D84p/D16p)^{1/2}$.

The shape factor SF1 of the toner particles is preferably from 140 to 155, more preferably from 143 to 153, and further preferably from 145 to 151.

In the case where the toner particles are produced by a pulverizing method such as a kneading pulverizing method, the shape of the toner particles is amorphous, and the shape factor SF1 is, for instance, 140 or more. In the toner particles having a shape factor SF1 of 140 or more, the release agent is likely to be exposed on the surface thereof owing to the production method. The release agent exposed on the surface is easily evaporated by the heat in the fixing of the toner, which readily results in the generation of the UFPs. Even in this case, however, the amount of the UFPs discharged to the outside of the image forming apparatus is reduced according to the exemplary embodiment.

The shape factor SF1 is given from the following equation.

Equation: $SF1=(ML^2/A)\times(\pi/4)\times100$

In this equation, ML represents the absolute maximum length of toner, and A represents the projected area of toner.

Specifically, the shape factor SF1 is converted into numerals principally by analyzing a microscopic image or a scanning electron microscopic (SEM) image with an image analyzer and calculated as follows. In particular, the optical microscopic image of particles scattered on the surface of a glass slide is input to an image analyzer LUZEX through a video camera to measure the maximum lengths and projected areas of 100 particles, the SF1 is calculated for them from the above equation, and the average thereof is obtained.

The toluene insoluble content in the toner particles is preferably from 25 mass % to 40 mass %, more preferably from 28 mass % to 38 mass %, and further preferably from 30 mass % to 35 mass %.

The toluene insoluble content in the toner particles in such a range enables the release agent to be confined in the toner particles, which reduces the exposure of the release agent on the surface of the toner particles. Thus, the generation of the UFPs derived from the release agent is reduced.

The toluene-insoluble component of the toner particles refers to the component that is contained in the toner particles but not dissolved in toluene. In other words, the toluene-insoluble component is an insoluble matter of which the principle component (for instance, 50 mass % or more of the whole) is a component of the binder resin that is not dissolved in toluene (particularly high-molecular-weight component of binder resin). The amount of the toluene-insoluble component can be an index of the cross-linked resin content in the toner.

The amount of the toluene-insoluble component is measured as follows.

Toner particles (or toner) weighed to 1 g are put into weighed cylindrical filter paper made of glass fibers, and this cylindrical filter paper is attached to the extraction tube of a thermal Soxhlet extractor. Toluene is put into a flask and heated to 110° C. with a mantle heater. A heater attached to the extraction tube is used to heat the surrounding of the extraction tube to 125° C. The extraction is performed at such a reflux rate that a single cycle of extraction is in the range of four minutes to five minutes. After the extraction is performed for 10 hours, the cylindrical paper filter and residual toner are retrieved, dried, and weighed.

Then, the amount (mass %) of the toner particle residue (or toner residue) is calculated on the basis of the following equation and defined as the amount of the toluene-insoluble component (mass %). Equation: amount (mass %) of toner particle residue (or toner residue)=[(weight of cylindrical filter paper+weight of residual toner) (g)−weight of cylindrical filter paper (g)] mass (g) of toner particles (or toner)× 100.

The toner particle residue (or toner residue) contains, for example, a colorant, an inorganic substance such as an external additive, and the high-molecular-weight component of the binder resin. In the case where the toner particles contain a release agent, the release agent is a toluene-soluble component because the extraction is carried out through heating.

The toluene-insoluble component of the toner particles is, for example, adjusted by (1) adding a cross-linking agent to a high-molecular-weight component having a reactive functional group at its end to form a cross-linked structure or a branched structure in the binder resin, (2) using a polyvalent metal ion in the binder resin to form a cross-linked structure or a branched structure in a high-molecular-weight component having an ionic functional group at its end, or (3) using, for instance, isocyanate in the binder resin to extend the chain structure of the resin or to allow it to branch.

External Additives

Examples of external additives include inorganic particles. Examples of the inorganic particles include $SiO_2$, $TiO_2$, $Al_2O_3$, CuO , ZnO , $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3SiO_2$, $CaCO_3$, $MgCO_3$, $BaSO_4$, and $MgSO_4$.

The surfaces of the inorganic particles as an external additive may be hydrophobized. The hydrophobization is performed by, for example, immersing the inorganic particles in a hydrophobizing agent. The hydrophobizing agent is not particularly limited; and examples thereof include silane coupling agents, silicone oils, titanate coupling agents, and aluminum coupling agents. These may be used alone or in combination The amount of the hydrophobizing agent is, for instance, generally from 1 part by mass to 10 parts by mass relative to 100 parts by mass of the inorganic particles.

Examples of the external additives also include resin particles [resin particles such as polystyrene particles, polymethyl methacrylate (PMMA) particles, and melamine resin particles] and cleaning aids (for instance, metal salts of higher fatty acids, such as zinc stearate, and particles of a high-molecular-weight fluorine material).

The amount of the external additive to be used is, for example, preferably from 0.01 mass % to 5 mass %, and more preferably from 0.01 mass % to 2.0 mass % relative to the amount of the toner particles.

Production of Toner

Production of the toner used in the exemplary embodiment will now be described.

The toner used in the exemplary embodiment can be produced by preparing toner particles and then externally adding an external additive to the toner particles.

The toner particles may be produced by any of a dry process (such as a kneading pulverizing' method) and a wet process (such as an aggregation coalescence method, a suspension polymerization method, or a dissolution suspension method). Production of the toner particles is not particularly limited to these production processes, and any of known techniques can be employed.

In particular, the toner particles are suitably produced by an aggregation coalescence method.

Aggregation Coalescence Method

Specifically, for example, production of the toner particles by an aggregation coalescence method include the following processes:

preparing a dispersion liquid of resin particles in which resin particles as the binder resin have been dispersed (preparation of dispersion liquid of resin particles), aggregating the resin particles (optionally with other particles) in the dispersion liquid of resin particles (dispersion liquid optionally mixed with a dispersion liquid of other particles) to form an aggregated particles (formation of aggregated particles), and heating a dispersion liquid of aggregated particles in which the aggregated particles have been dispersed to fuse and coalesce the aggregated particles into toner particles (fusion and coalescence).

Each of the processes will now be described in detail. In the following description, a method for producing the toner particles containing a colorant and a release agent will be explained; however, use of the colorant and the release agent is optional. Additives other than the colorant and the release agent may be obviously used. Preparation of Dispersion Liquid of Resin Particles The dispersion liquid of resin particles in which resin particles as a binder resin have been dispersed as well as, for example, a dispersion liquid of colorant particles in which colorant particles have been dispersed and a dispersion liquid of release agent particles in which release agent particles have been dispersed are prepared.

The dispersion liquid of the resin particles is, for example, prepared by dispersing the resin particles in a dispersion medium with a surfactant.

Examples of the dispersion medium used in the dispersion liquid of resin particles include aqueous media.

Examples of the aqueous media include water, such as distilled water and ion exchanged water, and alcohols. These aqueous media may be used alone or in combination.

Examples of the surfactant include anionic surfactants such as sulfuric acid ester salts, sulfonic acid salts, phosphoric acid esters, and soaps; cationic surfactants such as amine salts and quaternary ammonium salts; and nonionic surfactants such as polyethylene glycol, alkylphenol-ethylene oxide adducts and polyols. Among these surfactants, anionic surfactants and cationic surfactants may be used. Nonionic surfactants may be used in combination with anionic surfactants or cationic surfactants.

The surfactants may be used alone or in combination.

In the dispersion liquid of resin particles, the resin particles can be dispersed in the dispersion medium by any of known dispersion techniques; for example, general dispersers can be used, such as rotary shearing homogenizers or those having media, e.g., a ball mill, a sand mill, and a DYNO mill. Depending on the type of resin particles, the resin particles may be, for instance, dispersed in the dispersion liquid of resin particles by phase inversion emulsification.

In the phase inversion emulsification, a resin to be dispersed is dissolved in a hydrophobic organic solvent in which the resin can be dissolved, a base is added to an organic continuous phase (O phase) for neutralization, and then an aqueous medium (W phase) is added thereto to turn the phase to a discontinuous phase by the conversion of the resin (namely, phase inversion) from W/O to O/W, thereby dispersing the resin in the aqueous medium in the form of particles.

The volume average particle size of the resin particles to be dispersed in the dispersion liquid of resin particles is, for example, preferably from 0.01 μm to 1 μm, more preferably from 0.08 μm to 0.8 μm, and further preferably from 0.1 μm to 0.6 μm.

The volume average particle size of the resin particles is determined as follows. Particle size distribution is measured with a laser-diffraction particle size distribution analyzer (such as LA-700 manufactured by HORIBA, Ltd.), cumulative distribution by volume is drawn from the smaller particle size side in particle size ranges (channels) into which the measured particle size distribution is divided, and the particle size having a cumulative percentage of 50% relative to the whole particles is determined as the volume average particle size D50*v*. The volume average particle size of the particles in other dispersion liquids is similarly determined.

The amount of the resin particles contained in the dispersion liquid of resin particles is, for example, preferably from 5 mass % to 50 mass %, and more preferably from 10 mass % to 40 mass %.

The dispersion liquid of colorant particles and the dispersion liquid of release agent particles are, for instance, prepared in the same manner as the preparation of the dispersion liquid of resin particles. Accordingly, the volume average particle size of the particles, the dispersion medium, the dispersion method, and the amount of the particles in the dispersion liquid of resin particles are the same as those of the colorant particles dispersed in the dispersion liquid of colorant particles and the release agent particles dispersed in the dispersion liquid of release agent particles.

Formation of Aggregated Particles

The dispersion liquid of resin particles is mixed with the dispersion liquid of colorant particles and the dispersion liquid of release agent particles.

The resin particles, the colorant particles, and the release agent particles are hetero-aggregated in the mixed dispersion liquid to form aggregated particles having a diameter close to the intended diameter of the toner particles and containing the resin particles, the colorant particles, and the release agent particles.

Specifically, for example, an aggregating agent is added to the mixed dispersion liquid, and the pH of the mixed dispersion liquid is adjusted to be acidic (e.g., pH from 2 to 5). Then, a dispersion stabilizer is optionally added thereto, the resulting mixture is heated to a temperature corresponding to the glass transition temperature of the resin particles (in particular, for example, −30° C. or more and −10° C. or less of the glass transition temperature of the resin particles), and the particles dispersed in the mixed dispersion liquid are aggregated, thereby forming the aggregated particles.

In the formation of the aggregated particles, for instance, the aggregating agent may be added to the mixed dispersion liquid at room temperature (for instance, 25° C.) under stirring with a rotary shearing homogenizer, the pH of the mixed dispersion liquid may be adjusted to be acidic (e.g., pH from 2 to 5), a dispersion stabilizer may be optionally added thereto, and the resulting mixture may be heated.

Examples of the aggregating agent include surfactants having an opposite polarity to the surfactant used as a dispersant that is to be added to the mixed dispersion liquid, such as inorganic metal salts and di- or higher valent metal complexes. In the case where a metal complex is used as the aggregating agent, the surfactant can be used in a reduced amount, and charging properties can be improved.

An additive that forms a complex or a similar bond with the metal ions of the aggregating agent may be optionally used. Such an additive is suitably a chelating agent.

Examples of the inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent may be a water-soluble chelating agent. Examples of the chelating agent include oxycarboxylic acids such as tartaric acid, citric acid, and gluconic acid; iminodiacetic acid (IDA); nitrilotriacetic acid (NTA); and ethylenediaminetetraacetic acid (EDTA).

The amount of the chelating agent is, for example, preferably from 0.01 parts by mass to 5.0 parts by mass, more preferably 0.1 parts by mass or more and less than 3.0 parts by mass relative to 100 parts by mass of the resin particles.

Fusion and Coalescence

The dispersion liquid of aggregated particles in which the aggregated particles have been dispersed is, for example, heated to the glass transition temperatures or more of the resin particles (such as from 10° C. to 30° C. higher than the glass transition temperatures of the resin particles) to fuse and coalesce the aggregated particles, thereby forming the toner particles.

Through the above-mentioned processes, the toner particles are produced.

The method for forming the toner particles may have the following additional processes: after the dispersion liquid of aggregated particles in which the aggregated particles have been dispersed is obtained, the dispersion liquid of aggregated particles is further mixed with a dispersion liquid of resin particles in which the resin particles have been dispersed, and the particles are aggregated such that the resin particles further adhere to the surfaces of the aggregated particles to produce second aggregated particles; and a dispersion liquid of second aggregated particles in which the second aggregated particles have been dispersed is heated to fuse and coalesce the second aggregated particles, thereby producing toner particles having a core shell structure.

After the fusion and coalescence, the toner particles formed in the solution are washed, subjected to solid-liquid separation, and dried by known techniques to yield dried toner particles.

The washing may be sufficiently carried out by displacement washing with ion exchanged water in terms of charging properties. The solid-liquid separation is not particularly limited but may be suction filtration or pressure filtration in terms of productivity. The drying is not particularly limited but may be freeze drying, flush drying, fluidized drying, or vibratory fluidized drying in terms of productivity.

An external additive is, for instance, added to the produced toner particles that are in a dried state, and the resulting toner particles are mixed to produce the toner used in the exemplary embodiments. The mixing may be performed, for example, with a V-blender, a HENSCHEL MIXER, or a LOEDIGE MIXER. The coarse particles of the toner may be optionally removed with a vibrating sieve, an air sieve, or another device.

Kneading Pulverizing Method

The toner particles used in the exemplary embodiment may be produced by a pulverizing method such as a kneading pulverizing method. In the case where the toner particles are produced by a pulverizing method, the shape of the toner particles is amorphous, and the shape factor SF1 is, for example, in the above-mentioned range. The release agent is likely to be exposed on the surface of the toner particles owing to the production method, which readily results in the generation of the UFPs. Even in this case, however, the amount of the UFPs discharged to the outside of the image forming apparatus is reduced according to the exemplary embodiment.

The toner particles are produced by a kneading pulverizing method through melt-kneading, pulverizing, and classifying the binder resin and a release agent at least containing a specific paraffin wax having a melting temperature being in the above-mentioned range. The production of the toner particles by the kneading pulverizing method, for instance, includes a kneading process of melt-kneading materials including the binder resin and the release agent, a cooling process of cooling the melt-kneaded product, a pulverizing process of pulverizing the melt-kneaded product after the cooling process, and a classifying process of classifying the pulverized product.

Each of the processes of the kneading pulverizing method will now be described in detail.

Kneading Process

In the kneading process, materials including the binder resin and the release agent (materials for producing resin particles) are melt-kneaded to produce a kneaded product.

Examples of a kneader used in the kneading process include a three-roll kneader, a uniaxial screw kneader, a biaxial screw kneader, and a Banbury mixer.

The melting temperature may be determined on the basis of the types of binder resin and release agent to be kneaded and the content proportion thereof.

Cooling Process

In the cooling process, the kneaded product obtained in the kneading process is cooled.

In the cooling process, the temperature of the kneaded product is suitably decreased from the temperature of the kneaded product at the completion of the kneading process to 40° C. at an average temperature decrease rate of 4° C./s or more in order to maintain the dispersion state immediately after the kneading process.

The term "average temperature decrease rate" refers to the average of the rate taken to decrease the temperature of the kneaded product at the completion of the kneading process up to 40° C.

In the cooling process, the cooling is, for example, performed with a rolling roller, in which cold water or brine circulates, or a pinching type cooling belt. In the cooling in this manner, the cooling rate is determined, for instance, on the basis of the speed of the rolling roller, the flow rate of the brine, the amount of the kneaded product to be supplied, or a slab thickness during the rolling of the kneaded product. The slab thickness is suitable from 1 mm to 3 mm.

Pulverizing Process

The kneaded product cooled in the cooling process is pulverized in a pulverizing process to form particles.

In the pulverizing process, for example, a mechanical pulverizer, a jet pulverizer, or another pulverizer is used.

Classifying Process

The pulverized product (particles) obtained in the pulverizing process may be optionally classified in the classifying process.

In the classifying process, a typical centrifugal classifier, inertial classifier, or another classifier is used to remove fine powder (particles having a particle size smaller than the intended size) and coarse powder (particles having a particle size larger than the intended size).

An external additive is, for instance, added to the produced toner particles that are in a dried state, and the resulting toner particles are mixed to produce the toner used in the exemplary embodiments. The mixing may be performed, for example, with a V-blender, a HENSCHEL MIXER, or a LOEDIGE MIXER. The coarse particles of the toner may be optionally removed with a vibrating sieve, an air sieve, or another device.

Electrostatic Charge Image Developer

The electrostatic charge image developer used in the exemplary embodiment at least contains the toner used in the exemplary embodiment.

The electrostatic charge image developer used in the exemplary embodiment may be a single component developer containing only the toner used in the exemplary embodiment or may be a two component toner that is a mixture of the toner and a carrier.

The carrier is not particularly limited, and any of known carriers can be used. Examples of the carrier include coated carriers in which the surface of a core formed of magnetic powder has been coated with a coating resin, magnetic powder dispersed carriers in which magnetic powder has been dispersed in or blended with a matrix resin, and resin impregnated carriers in which porous magnetic powder has been impregnated with resin.

In the magnetic powder dispersed carriers and the resin impregnated carriers, the constituent particles may have a surface coated with a coating resin.

Examples of the magnetic powder include magnetic metals, such as iron, nickel, and cobalt, and magnetic oxides such as ferrite and magnetite.

Examples of the coating resin and matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylate copolymers, straight silicone resins containing an organosiloxane bond or a modified product thereof, fluororesins, polyester, polycarbonate, phenol resins, and epoxy resins.

The coating resin and the matrix resin may contain other additives such as conductive particles.

Examples of the conductive particles include particles of metals such as gold, silver, and copper; carbon black particles; titanium oxide particles; zinc oxide particles; tin oxide particles; barium sulfate particles; aluminum borate particles; and potassium titanate particles.

An example of the preparation of the coated carrier involves coating with a coating layer forming solution in which the coating resin and optionally a variety of additives have been dissolved in a proper solvent. The solvent is not particularly limited and may be determined in view of, for instance, the type of coating resin to be used and coating suitability.

Specific examples of the coating method include a dipping method of dipping the core into the coating layer forming solution, a spray method of spraying the coating layer forming solution onto the surface of the core, a fluid-bed method of spraying the coating layer forming solution to the core that is in a state of being floated by the flowing air, and a kneader coating method of mixing the core of the carrier with the coating layer forming solution in the kneader coater and removing a solvent.

The mixing ratio (mass ratio) of the toner to the carrier in the two-component developer (toner:carrier) is preferably from 1:100 to 30:100, and more preferably from 3:100 to 20:100.

EXAMPLES

The present disclosure will now be further specifically described in detail with reference to Examples and Comparative Examples but is not limited thereto at all.

Production of Crystalline Resin (A)

Into a three-neck flask, 100 parts by mass of dimethyl sebacate, 67.8 parts by mass of hexanediol, and 0.10 parts by mass of dibutyltin oxide are put. The mixture is reacted at 185° C. for 5 hours under nitrogen atmosphere while water generated in the reaction is removed to the outside. Then, the temperature is increased up to 220° C. while the pressure is gradually reduced, and the resulting product is further reacted for 6 hours and then cooled. Through this process, a crystalline resin (A) having a weight average molecular weight of 33,700 is prepared.

Production of Amorphous Resin

Production of Amorphous Resin (1)

Into a three-neck flask, 61 parts by mass of dimethyl terephthalate, 75 parts by mass of dimethyl fumarate, 34 parts by mass of dodecenylsuccinic anhydride, 16 parts by mass of trimellitic acid, 137 parts by mass of ethylene oxide adducts of bisphenol A, 191 parts by mass of propylene oxide adducts of bisphenol A, and 0.3 parts by mass of dibutyltin oxide are put. The mixture is reacted at 180° C. for 3 hours under nitrogen atmosphere while water generated in the reaction is removed to the outside. Then, the temperature is increased up to 280° C. while the pressure is gradually reduced, and the resulting product is reacted for 2 hours and then cooled. Through this process, an amorphous polyester resin (1) having a weight average molecular weight of 19,000 is produced.

Production of Amorphous Resin (2)

The amounts of the dimethyl terephthalate, dimethyl fumarate, dodecenylsuccinic anhydride, and trimellitic acid are changed to 60 parts by mass, 74 parts by mass, 30 parts by mass, and 22 parts by mass, respectively; except for that, an amorphous resin (2) is produced as in the production of the amorphous resin (1). The weight average molecular weight of the amorphous resin (2) is 19,500.

Production of Amorphous Resin (3)

The amounts of the dimethyl terephthalate, dimethyl fumarate, dodecenylsuccinic anhydride, and trimellitic acid are changed to 60 parts by mass, 70 parts by mass, 29 parts by mass, and 29 parts by mass, respectively; except for that, an amorphous resin (3) is produced as in the production of the amorphous resin (1). The weight average molecular weight of the amorphous resin (3) is 18,200.

Production of Amorphous Resin (4)

The amounts of the dimethyl terephthalate, dimethyl fumarate, dodecenylsuccinic anhydride, and trimellitic acid are changed to 55 parts by mass, 64 parts by mass, 27 parts by mass, and 46 parts by mass, respectively; except for that, an amorphous resin (4) is produced as in the production of the amorphous resin (1). The weight average molecular weight of the amorphous resin (4) is 17,200.

Production of Toner

Production of Toner (1)

Into a HENSCHEL MIXER (manufactured by NIPPON COKE & ENGINEERING CO., LTD.), 79 parts by mass of the amorphous polyester resin (1), 7 parts by mass of a colorant (C.I. Pigment Blue 15:1), 5 parts by mass of a release agent (paraffin wax manufactured by NIPPON SEIRO CO., LTD., melting temperature of 73° C.), and 8 parts by mass of the crystalline resin (A) (melting point: 71° C.) are put. The mixture is stirred and mixed at a rotational speed of 15 m/s for 5 minutes, and the resulting mixture is melt-kneaded with an extruder-type continuous kneader.

In the extruder-type continuous kneader, the temperature is 160° C. on the supply side and 130° C. on the discharge side, the temperature of a cooling roller is 40° C. on the supply side and 25° C. on the discharge side. The temperature of a cooling belt is adjusted to be 10° C.

The melt-kneaded product is cooled, then roughly pulverized with a hammer mill, and subsequently finely pulverized with a jet pulverizer (manufactured by Nippon Pneumatic Mfg. Co., Ltd.) to 6.5 μm. The resulting product is classified with an elbow-jet classifier (type: EJ-LABO, manufactured by Nittetsu Mining Co., Ltd.) to yield toner particles having a volume average particle size of 6.9 μm. The toner particles have an SF1 of 145 and a toluene-insoluble content of 25 mass %.

Production of Toner (2)

Except that the amorphous resin (2) is used in place of the amorphous resin (1), toner particles having a volume average particle size of 6.8 μm are produced as in the production of the toner (1). The toner particles have an SF1 of 147 and a toluene-insoluble content of 29 mass %. Production of Toner (3)

Except that the amorphous resin (3) is used in place of the amorphous resin (1), toner particles having a volume average particle size of 7.0 μm are produced as in the production of the toner (1). The toner particles have an SF1 of 149 and a toluene-insoluble content of 35 mass %.

Production of Toner (4)

Except that the amorphous resin (4) is used in place of the amorphous resin (1), toner particles having a volume average particle size of 7.3 μm are produced as in the production of the toner (1). The toner particles have an SF1 of 151 and a toluene-insoluble content of 40 mass %.

Production of Toner (C1)

Except that the paraffin wax used in the production of the toner (1) is changed to another paraffin wax (POLYWAX 725 manufactured by BAKER PETROLITE, melting temperature: 105° C.), toner particles having a volume average particle size of 7.0 μm are produced as in the production of the toner (1). The toner particles have an SF1 of 146 and a toluene-insoluble content of 45 mass %.

Production of Toner and Developer

With 100 parts by mass of the individual toner particles, 1.2 parts by mass of an external additive that is a commercially available fumed silica RX50 (manufactured by NIPPON AEROSIL CO., LTD.) is mixed using a HENSHEL MIXER (manufactured by MITSUI MIIKE MACHINERY Co., Ltd.) at a rotational speed of 30 m/s for 5 minutes, thereby obtaining toners (1) to (4) and (C1), respectively.

With 100 parts by mass of a carrier, 8 parts by mass of the individual toners are mixed to produce developers (1) to (4) and (C1), respectively.

In order to produce the carrier, 14 parts by mass of toluene and 2 parts by mass of a styrene-methyl methacrylate copolymer (component ratio: styrene/methyl methacrylate=90/10, weight average molecular weight Mw: 80,000) are stirred for 10 minutes with a stirrer to prepare a coating liquid in which these materials have been dispersed. The coating liquid and 100 parts by mass of ferrite particles (volume average particle size: 50 μm) are put into a vacuum degassing kneader (manufactured by INOUE MFG., INC.) and stirred at 60° C. for 30 minutes. Then, the pressure is reduced for degassing under heating to dry the resulting product, and the dried product is filtered with a 105 μm sieve to yield the carrier.

Examples A1 to A5

An image forming apparatus (modified machine of DOCUCOLOR 1450 manufactured by Fuji Xerox Co., Ltd.) is prepared.

This image forming apparatus has been modified so as to have a fixing device that has a similar structure to the fixing device illustrated in FIG. 2 (fixing device A) and that includes a collection member which is disposed in contact with the endless member to be heated so as to face the outer surface of the fixing belt and to be rotatable in the direction opposite to the running direction of the fixing belt. The collection member is a brush roller (collection member in the form of a brush). The brush roller includes a hollow shaft and a brush attached to the circumference of the hollow shaft. The brush roller is disposed in the vicinity of the contact region, in which the endless member is in contact with the second heating roller, and upstream of the contact region in the operational direction of the endless member (in particular, disposed so as to be apart from the initial end of the contact region in the operational direction of the endless member by 20 mm). In Examples A1 to A4, the brush roller has a structure in which particles are suctioned by drawing air from the hollow shaft; in Example A5, the brush roller has a structure in which particles are not suctioned. In addition, a filter attached to an air outlet of the image forming apparatus is removed. The preset fixing temperature of the first heating roller is 145° C., and the preset fixing temperature of the second heating roller is 160° C.

The developers shown in Table 1 are individually put into the developing device of the image forming apparatus.

Examples B1 to B4

An image forming apparatus (modified machine of DOCUCOLOR 1450 manufactured by Fuji Xerox Co., Ltd.) is prepared.

This image forming apparatus has been modified so as to have a fixing device that has a similar structure to the fixing device illustrated in FIG. 3 (fixing device B) and that includes a collection member which is disposed so as to face the outer surface of the fixing belt. The collection member is a porous collection member. The porous collection member is disposed in the vicinity of the contact region, in which the endless member to be heated is in contact with the second heating roller, and upstream of the contact region in the operational direction of the endless member to be heated so as not to contact with the fixing belt (in particular, disposed such that the distance from the second heater to the collection member is from 30 nm to 70 nm). The porous collection member is formed of polyphenylene sulfide, the ratio of the pore area to the total area (pore area/total area) is 5, the average pore size is 0.1 μm, and thickness is 5 mm or less. The porous collection member does not serve for suction. In addition, a filter attached to an air outlet of the image forming apparatus is removed. The preset fixing temperature of the first heating roller is 170° C., and the preset fixing temperature of the second heating roller is 160° C.

The developers shown in Table 1 are individually put into the developing device of the image forming apparatus.

Comparative Examples 1 and 2 and Reference Example

An image forming apparatus that is the modified machine used in Examples A1 to A5 and B1 to B4 is prepared. This image forming apparatus of the modified machine has a fixing device that does not have a collection member. The preset fixing temperatures are the same as in the case of using the fixing device A or the fixing device B.

The developers shown in Table 1 are individually put into the developing device of the image forming apparatus.

Evaluations

Evaluation of Fixability at Low Temperature

A patch of an unfixed image which has a size of 4 cm×5 cm and in which the toner is to be used in an amount of 4.0 g/m$^2$ is formed on J paper (A4 size). This patch is printed at a fixed processing speed of 140 mm/s, and the printed image is fixed with fixing temperature (preset fixing temperature of the first heating roller) being changed from 80° C. to 180° C. by 5° C. The lowest fixing temperature at which offset does not occur (lowest fixing temperature) is determined. The preset fixing temperature of the second heating roller is fixed to be 180° C.

In the evaluation, the lowest fixing temperature is less than 130° C. in Examples A1 to A4 and B1 to B4 and Comparative Examples 1 and 2, and this result shows that Examples A1 to A4 and B1 to B4 and Comparative Examples 1 and 2 are good in fixability at low temperature. In Reference Example, the melting temperature of the release agent is high, and the lowest fixing temperature is therefore higher than those in Examples A1 to A4 and B1 to B4 and Comparative Examples 1 and 2 (140° C. or more); this result shows that Reference Example is poor in fixability at low temperature.

Evaluation of UFP

An image having an image density of 1000 is continuously formed on both sides of 1000 sheets of A3-size paper at a temperature of 22° C., relative humidity (RH) of 55%, and the preset fixing temperature shown in Table 1. The particle emission rate ($PER_{10\ PW}$) of the UFPs discharged from the image forming apparatus during the formation of the image is measured at Test Laboratory of Fuji Xerox Co., Ltd. in accordance with RAL UZ-171.

The value of the measured particle emission rate [unit (number of particles/10 min)] is evaluated and graded from G1 to G3. The particle emission rate in Comparative Examples in which the fixing device without a collection member is used is graded G3 and serves as the standard to perform relative evaluation. The particle emission rate is smallest in G1, which means that the amount of the UFPs is small.

TABLE 1

| | Developer | | Fixing device | | | | | |
|---|---|---|---|---|---|---|---|---|
| | | | | Collection member | | | | |
| | Toner type | Melting temperature of release agent T2 (° C.) | Type | Structure | Air suction | Preset fixing temperature of second heating roller [T1] (° C.) | [T1 − T2] (° C.) | Evaluation amount of discharged UFP |
| Example A1 | (1) | 73 | A | Brush | Yes | 160 | 87 | G1 |
| Example A2 | (2) | 73 | A | Brush | Yes | 160 | 87 | G1 |
| Example A3 | (3) | 73 | A | Brush | Yes | 160 | 87 | G1 |
| Example A4 | (4) | 73 | A | Brush | Yes | 160 | 87 | G1 |
| Example A5 | (1) | 73 | A | Brush | No | 160 | 87 | G2 |
| Example B1 | (1) | 73 | B | Porous member | No | 160 | 87 | G2 |
| Example B2 | (2) | 73 | B | Porous member | No | 160 | 87 | G2 |
| Example B3 | (3) | 73 | B | Porous member | No | 160 | 87 | G2 |
| Example B4 | (4) | 73 | B | Porous member | No | 160 | 87 | G2 |
| Comparative Example 1 | (1) | 73 | A | — | No | 160 | 87 | G3 |
| Comparative Example 2 | (1) | 73 | B | — | No | 160 | 87 | G3 |
| Reference Example | (C1) | 105 | A | — | No | 160 | 55 | G1 |

From the results shown in the table, the amount of the discharged UFPs derived from the release agent used in the toner is reduced more in Examples than in Comparative Examples.

Since the melting temperature of the release agent used in the toner is greater than 100° C. in Reference Example, the amount of discharged UFPs derived from the release agent used in the toner is small.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image holding member;

a charging unit hat charges a surface of the image holding member;

an electrostatic charge image forming unit that forms an electrostatic charge image on the charged surface of the image holding member;

a developing unit that includes a developer containing toner particles containing a release agent having a melting temperature ranging from 60° C. to 100° C. and that develops the electrostatic charge image on the surface of the image holding member with the developer to form a toner image;

a transferring unit that transfers the toner image formed on the surface of the image holding member to a surface of a recording medium; and a fixing unit that fixes the toner image transferred to the surface of the recording medium, wherein the fixing unit includes an endless member to be heated, the endless member contacts with the toner image transferred to the surface of the recording medium;

a pressure member that presses the endless member to form a nipping region between the pressure member and the endless member;

a first heater that is in contact with an inner surface of the endless member in the nipping region to heat the endless member;

a second heater that is disposed in contact with the endless member and downstream of the first heater in the operational direction of the endless member to heat the endless member; and a collection member that is a porous collection member or a dense collection member disposed in the vicinity of the second heater so as to face an outer surface of the endless member without contacting the outer surface of the endless member and that collects and retains ultrafine particles derived from the release agent from being discharged to the outside of the image forming apparatus.

2. The image forming apparatus according to claim 1, wherein the melting temperature of the release agent ranges from 60° C. to 90° C.

3. The image forming apparatus according to claim 1, wherein the release agent is a paraffin wax.

4. The image forming apparatus according to claim 1, wherein the toner particles contain a crystalline resin.

5. The image forming apparatus according to claim 4, wherein an amount of the crystalline resin ranges from 3 mass % to 20 mass % relative to a mass of the toner particles.

6. The image forming apparatus according to claim 4, wherein the amount of the crystalline resin ranges from 5 mass % to 15 mass % relative to a mass of the toner particles.

7. The image forming apparatus according to claim 1, wherein a toluene-insoluble content of the toner particles contained in the developer ranges from 25 mass % to 40 mass %.

8. The image forming apparatus according to claim 1, wherein the toner particles have a shape factor SF1 of 140 or more.

9. The image forming apparatus according to claim 1, wherein the collection member contains polyphenylene sulfide.

10. The image forming apparatus according to claim 1, wherein a ratio of s pore area of the porous collection member to a total area of the porous collection member is 5 or more, and the porous collection member has an average pore size ranging from 0.1 μm to 2.0 μm and a thickness ranging from 0.5 mm to 50 mm.

11. The image forming apparatus according to claim 1, wherein the second heater has a preset fixing temperature ranging from 100° C. to 200° C.

12. The image forming apparatus according to claim 1, wherein the second heater has a preset fixing temperature ranging from 120° C. to 200° C.

13. The image forming apparatus according to claim 1, wherein the second heater is in contact with the inner surface of the endless member.

14. The image forming apparatus according to claim 1, wherein the second heater is in contact with the outer surface of the endless member to form a contact region, and the collection member is disposed in the vicinity of the contact region and upstream of the contact region in the operational direction of the endless member.

15. The image forming apparatus according to claim 1, wherein the difference between a preset fixing temperature of the second heater and the melting temperature of the release agent used in the toner particles ranges from 30° C. to 140° C.

* * * * *